US006042769A

United States Patent [19]

Gannon et al.

[11] Patent Number: 6,042,769

[45] Date of Patent: Mar. 28, 2000

[54] LYOCELL FIBRE AND A PROCESS FOR ITS MANUFACTURE

[75] Inventors: James Martin Gannon, Coventry; Ian Graveson, Nuneaton; Pamela Ann Johnson, Coventry; Calvin Roger Woodings, Nuneaton, all of United Kingdom

[73] Assignee: Acordis Fibres (Holdings ) Limited, United Kingdom

[21] Appl. No.: 08/750,304

[22] PCT Filed: Jun. 19, 1995

[86] PCT No.: PCT/GB95/01439

§ 371 Date: Dec. 4, 1996

§ 102(e) Date: Dec. 4, 1996

[87] PCT Pub. No.: WO95/35399

PCT Pub. Date: Dec. 28, 1995

[30] Foreign Application Priority Data

Jun. 22, 1994 [GB] United Kingdom ..... 94125002

[51] Int. Cl.[7] ..... D01F 4/00

[52] U.S. Cl. ..... 264/203; 264/211.15; 264/233

[58] Field of Search ..... 264/129, 143, 264/187, 203, 211.14, 210.8, 210.7, 233, 211.15; 106/125, 168, 176, 126, 186, 198, 162, 163, 200.3

[56] References Cited

U.S. PATENT DOCUMENTS

| | | | |
|---|---|---|---|
| 4,246,221 | 1/1981 | McCorsley, III . | |
| 4,374,702 | 2/1983 | Turbak et al. | 162/100 |
| 5,403,530 | 4/1995 | Taylor . | |
| 5,571,468 | 11/1996 | Meraldi et al. | 264/187 |
| 5,690,874 | 11/1997 | Bell et al. | 264/129 |
| 5,700,599 | 12/1997 | Danko et al. | 429/249 |
| 5,725,821 | 3/1998 | Gannon et al. | 264/203 |

FOREIGN PATENT DOCUMENTS

| | | |
|---|---|---|
| 9214871 | 9/1992 | WIPO . |
| 9514398 | 6/1995 | WIPO . |
| 9535400 | 12/1995 | WIPO . |

OTHER PUBLICATIONS

U.S. Ser. No. 648,088, Woodings., filed Nov. 1994.

U.S. Ser. No. 750,305, Gannon et al., filed Dec. 1996.

Rudi Breier, "Die Verendlung Von Lyocellfasern–Ein Erfahrungsbericht", *Lenzinger Berichte, No. 9*: pp. 99–101 (Sep. 1994) [English Translation provided].

H. Firgo et al., "Kritische Fragen Zur Zukunft Der NMMO–Technolgie", *Lenzinger Berichte, No. 9*: pp. 81–89 (Sep. 1994) [English translation provided].

V.V. Romanov and O.B. Lunina, "Preparation of Hydrocellulose Fibres from Highly Concentrated Solutions of Cellulose in N–Methylmorphine–N–Oxide", *Fibre Chemistry*, vol. 25, No. 5, pp. 368–371 (1993).

*Primary Examiner*—Donna C. Wortman

*Attorney, Agent, or Firm*—Howson and Howson

[57] ABSTRACT

The fibrillation tendency of solvent-spun fiber can be increased by subjecting the fiber to a treatment which reduces its degree of polymerisation by about 200 units or more. Suitable methods of treatment include severe bleaching, for example application of an aqueous liquor containing 0.1 to 10 percent by weight sodium hypochlorite (as available chlorine) to the fiber followed by steaming. Fiber may be treated in never-dried or previously-dried form. Fiber treated by the process of the invention is useful for example in the manufacture of paper and hydroentangled fabrics. Fiber of increased tendency to fibrillation can be beaten to a Canadian Standard Freeness 400 in the Disintegration Test by 30,000–150,000 disintegrator revolutions and to a Canadian Standard Freeness 200 in the same Test by 50,000–200,000 disintegrator revolutions.

11 Claims, 4 Drawing Sheets

LYOCELL FIBRE AND A PROCESS FOR ITS MANUFACTURE

FIELD OF THE INVENTION

This invention relates to a process for manufacturing lyocell fibre with an increased tendency to fibrillation and to lyocell fibre having an increased tendency to fibrillation.

It is known that cellulose fibre can be made by extrusion of a solution of cellulose in a suitable solvent into a coagulating bath. This process is referred to as "solvent-spinning", and the cellulose fibre produced thereby is referred to as "solvent-spun" cellulose fibre or as lyocell fibre. Lyccell fibre is to be distinguished from cellulose fibre made by other known processes, which rely on the formation of a soluble chemical derivative of cellulose and its subsequent decomposition to regenerate the cellulose, for example the viscose process. Lyocell fibres are known for their impressive textile physical properties, such as tenacity, in comparison with fibres such as viscose rayon fibres. One example of a solvent-spinning process is described in U.S. Pat. No. 4,246,221, the contents of which are incorporated herein by way of reference. Cellulose is dissolved in a solvent such as an aqueous tertiary amine N-oxide, for example N-methylmorpholine N-oxide. The resulting solution is then extruded through a suitable die into an aqueous bath to produce an assembly of filaments which is washed with water to remove the solvent and is subsequently dried.

Fibres may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Such fibrillation is believed to be caused by mechanical abrasion of the fibres during treatment in a wet and swollen state. Higher temperatures and longer times of treatment generally tend to produce greater degrees of fibrillation. Lyocell fibre appears to be particularly sensitive to such abrasion and is consequently often found to be more susceptible to fibrillation than other types of cellulose fibre. Intensive efforts have been made to reduce the fibrillation of lyocell fibres.

The presence of fibrillated fibres is advantageous in certain end-uses. For example, filter materials containing fibrillated fibres generally have high efficiency. Fibrillation is induced in paper-making processes by beating the fibres, which is generally known to increase the strength and transparency of the paper. Fibrillation may also be utilised in the manufacture of non-woven fabrics, for example hydroentangled fabrics, to provide improved cohesion, cover and strength. Although the fibrillation tendency of lyocell fibres is higher than that of other cellulose fibres, it is not always as great as may be desired for some end-uses. It is an object of the present invention to provide lyocell fibre with an increased fibrillation tendency.

DISCLOSURE OF THE INVENTION

The present invention provides a process for the manufacture of lyocell fibre with an increased tendency to fibrillation, including the steps of:

(1) dissolving cellulose in a solvent to form a solution, (2) extruding the solution through a die to form a plurality of filaments, and (3) washing the filaments to remove the solvent, thereby forming lyocell fibre; and the characterising step of (4) subjecting the lyocell fibre to conditions effective to reduce the Degree of Polymerisation of the cellulose by at least about 200 units.

The solvent preferably comprises a tertiary amine N-oxide, more preferably N-methylmorpholine N-oxide (NMMO), and it generally contains a small proportion of water. When a water-miscible solvent such as NMMO is used, the filaments are generally washed in step (3) with an aqueous liquor to remove the solvent from the filaments.

Lyocell fibre at the end of step (3) is in never-dried form and generally requires to be dried. In one embodiment of the invention, the degradation step (4) is performed on never-dried fibre which is subsequently dried. In another embodiment of the invention, the fibre is dried between steps (3) and (4). Use of the degradation step (4) according to the invention on previously-dried fibre may be convenient if batchwise processing or longer treatment times are desired. Previously-dried fibre may be treated in the form of fibre, yarn or fabric, including woven, knitted and non-woven fabric.

Lyocell fibre is produced in the form of tow which is commonly converted into short length staple fibre for further processing, either in the never-dried or dried state. A lyocell tow may be converted into staple fibre either before or after the degradation step (4) and either before or after drying.

The lyocell fibre manufactured by the process of the invention may be unzigmented (bright or ecru) or pigmented, for example incorporating a matt pigment such as titanium dioxide.

The degree of polymerisation (D.P.) of cellulose is conveniently assessed by viscosimetry of a dilute solution of cellulose in a solvent which is an aqueous solution of a metal/amine complex, for example cuprammonium hydroxide solution. A suitable method, based on TAPPI Standard T206, is described hereinafter as Test Method 1. Cellulose D.P. is a measure of the number of anhydroglucose units per molecule. It will be understood that D.P. measured in this manner is a viscosity-average D.P.

The desired reduction in cellulose D.P. in the degradation step (4) may be achieved in a number of ways. In one embodiment of the invention, the D.P. is reduced by a bleaching treatment, preferably using a bleaching liquor. The bleaching liquor may be applied to the fibre by passage through a bath, by padding, or by spraying, for example, particularly by spraying the liquor onto a tow of fibre emerging from a nip between rollers.

Bleaching of never-dried fibre may be carried out using an aqueous solution comprising a hypochlorite such as sodium hypochlorite, for example a solution containing 0.1 to 10, preferably 0.25 to 4, more preferably 0.5 to 2, percent by weight NaOCl (expressed as available chlorine). The bleaching liquor may optionally contain in addition an alkali such as sodium hydroxide, for example up to about 0.5 or up to about 1 percent by weight sodium hydroxide. Alternatively, the pH of the bleaching liquor may be controlled in the range from 5.5 to 8, preferably around 6 to 7. Degradation has been found to be relatively rapid in these pH ranges. A hypochlorite bleaching liquor may if desired be applied to the fibre at elevated temperature, for example about 50° C. Less concentrated bleach liquors may be used in the batchwise treatment of previously-dried lyocell fibre. For example, the bleaching liquor may contain 0.1 to 1 percent by weight available chlorine, and bleaching conducted at slightly elevated temperature, for example 30 to 60° C., for 1 to 3 hours.

Bleaching may alternatively be carried out using an aqueous solution comprising a peroxide, particularly hydrogen peroxide, for example a solution containing 0.5 to 20, preferably 1 to 6, more preferably 1 to 4, percent by weight hydrogen peroxide. A peroxide bleaching liquor preferably additionally contains an alkali such as sodium hydroxide, for example about 0.05 to about 1.0 percent by weight sodium hydroxide. The pH of an alkaline peroxide bleaching liquor is preferably in the range from 9 to 13, more preferably 10 to 12. Preferably, no peroxide stabiliser is used. Acidic peroxide solutions (pH 1 or less) may alternatively be used. A peroxide bleaching liquor is preferably applied to the fibre at ambient temperature or below to minimise unwanted decomposition of the peroxide. Peroxide bleaching liquors have generally been found to be less effective in reducing cellulose D.P. than hypochlorite bleaching liquors, and accordingly the latter may be preferred if large reductions in D.P. are desired. The effectiveness of a peroxide treatment may be increased by pretreating the lyocell fibre with a solution of a transition metal ion which catalyses the decomposition of peroxide ions, for example copper or iron cations. It will be appreciated that such pretreatment is preferably used in conjunction with a peroxide liquor application technique which does not involve a circulating bath.

The effectiveness of a bleaching treatment such as hypochlorite or peroxide bleaching may alternatively be enhanced by exposure to ultraviolet radiation.

After the fibre has been wetted with a bleaching liquor, it is preferably heated to induce and accelerate the degradation reaction during which the D.P. of the cellulose is reduced. For example, a tow of lyocell fibre wetted with bleaching liquor may be passed through a steam tunnel or heated J-box. Wet or superheated steam may be used. The temperature in a steam tunnel may be in the approximate range from 80 to 130° C. and the residence time may be in the range from 10 to 200 or 20 to 60 seconds, although it will be understood that temperature and time are to be chosen having regard to the degree of reduction in cellulose D.P. desired. Other types of equipment such as a J-box or a bed steamer may be used if longer steaming times, for example in the range from 5 to 30 minutes, are desired. Alternatively, fibre wetted with a hypochlorite bleaching liquor may be treated with aqueous acid or an acidic or particularly a neutral buffer solution to cause degradation to occur.

Alternatively, previously dried lyocell fibre may be subjected to degradation step (4) according the invention using conventional bleaching equipment for cotton, for example a kier. Further alternatively, never-dried or previously dried lyccell fibre may be subjected in tow or staple form to degradation step (4) according to the invention utilising conventional equipment6 for the continuous wet treatment of wet-spun fibres. For example, the lyocell fibre may be laid onto a continuous woven mesh belt and then passed under a series of sprays or other liquor distribution devices alternating with mangle rollers, using the type of equipment generally known for washing newly-spun viscose rayon. Longer treatment times are more readily obtained using such alternative types of equipment than when a wetted tow is passed through a steam tunnel.

Alternatively, other bleaching treatments known in the art for cellulose may be used, for example chlorite bleaching. Aggressive conditions should. generally be chosen to ensure a significant reduction in D.P.

In another embodiment of the invention, cellulose D.P. is reduced by treating the lyocell fibre with aqueous acid. The acid is preferably a mineral acid, more preferably hydrochloric acid, sulphuric acid or in particular nitric acid. For example, the fibre may be wetted with a solution containing from about 0.2 to about 4.5 percent by weight concentrated nitric acid in water. After wetting with acid, the fibre is preferably heated to cause the desired reduction in D.P., for example by passage through a steam tunnel as described hereinabove with respect to aqueous bleaching processes.

After treatment with a bleaching or acid liquor to reduce cellulose D.P., the lyocell fibre is generally washed to remove traces of the chemicals used to induce degradation and any byproducts and is generally then dried in known manner.

Other methods known in the art which reduce the D.P. of cellulose may also be employed, for example exposure to cellulolytic enzymes, electron beam radiation, ozone, ultrasonic vibrations or treatment with peroxy compounds such as peracetic acid, or persulphate and perborate salts. Combinations of two or more methods may be used. Ultrasonic treatment may additionally serve to induce fibrillation in the fibre.

The D.P.-reducing step (4) generally degrades the tensile properties of the lyocell fibres. This would normally be thought to be most undesirable. It has nevertheless been found that fibre produced according to the process of the invention has generally satisfactory tensile properties for use in the end-uses in which highly fibrillating fibre is desired, for example the manufacture of paper and non-woven articles.

The D.P. of cellulose used in the manufacture of known lyocell fibre is commonly in the range 400 to 1000, often 400 to 700. The D.P. of cellulose in lyocell fibre produced by the process of the invention may be below about 250, more preferably below about 200, below about 150 or about 100. The D.P. of cellulose in lyocell fibre produced by the process of the invention is preferably at least minus 75, because at lower values than this the fibre tends to disintegrate. (It will be appreciated that, although a negative D.P. is a physical impossibility, the quoted values of D.P. are obtained by applying the standard conversion to solution viscosity measurements in the manner hereinbefore described and not by direct measurement.) The D.P. of cellulose in lyocell fibre produced by the process of the invention is preferably in the range 0 to 350, further preferably 150 to 250, particularly if the D.P. of the lyocell fibre before treatment in the degredation step (4) is in the range 500 to 600. The D.P. of the cellulose may be reduced by at least about 300 units in the degradation step. The D.P. of the cellulose may be reduced by about 200 to about 500 units, often about 300 to about 400 units in the degradation step. It has surprisingly been found that the fibrillation tendency of lyocell fibre produced by the process of the invention is markedly higher than that of lyocell fibre of the same D.P. manufactured using low D.P. cellulose as starting material and omitting the D.P.-reducing step of the invention, for example if the fibre D.P. is about 400.

The titre of the fibre subjected to the degradation step (4) according to the invention may generally be in the range 0.5 to 30 dtex. It has been found that the process of the invention is most effective in increasing the fibrillation tendency of fibres of relatively low titre, for example 1 to 5 dtex or 1 to 3 dtex, perhaps on account of their greater surface to volume ratio.

It has been observed that the fibrillation tendency of lyocell fibre is directly related to the cellulose concentration of the solution from which it is made. It will be understood that raising the cellulose concentration generally necessitates a reduction in cellulose D.P. to maintain the viscosity of the solution below the practical maximum working viscosity. The increase in fibrillation tendency achievable by use of the process of the invention is generally greater than the increase achievable by raising the cellulose concentration of the solution.

Lyocell fibre produced by the process of the invention is useful for example in the manufacture of paper and nonwoven articles, either alone or in blends with other types of fibre, including standard lyocell fibre. A papermaking slurry containing lyocell fibre produced by the process of the invention requires markedly less mechanical work, for example beating, refining, disintegration or hydrapulping, to reach a chosen degree of freeness than slurry containing standard lyocell fibre. This is a particular advantage of the invention. The process of the invention may reduce the working time required by a high shear device on the resulting fibre to 50 percent or less, preferably 20 percent or less, further preferably 10 percent or less, of that required to achieve a given freeness using standard fibre. Methods which reduce working time to a value in the range from about 20 to about 50 percent, or from about 20 to about 33 percent, of that required for standard fibre may be preferred. Lyocell fibre produced according to the invention may fibrillate in low-shear devices such as hydrapulpers, which induce little or no fibrillation in conventional fibres under usual operating conditions. Lyocell fibre produced according to the process of the invention may have enhanced absorbency and wicking properties compared with conventional lyocell fibre, making it useful in the manufacture of absorbent articles.

The susceptibility of a fibre to fibrillation on mechanical working may conveniently be assessed by subjecting a dilute slurry of the fibre to mechanical working under standard conditions and measuring the drainage properties (freeness) of the slurry after various extents of working. The freeness of the slurry falls as the degree of fibrillation increases. Prior art lyocell fibre is typically capable of being beaten to Canadian Standard Freeness 400, using the Disintegration Test defined hereinafter as Test Method 3, by a number of disintegrator revolutions in the range from about 200,000 to about 250,000 and to Canadian Standard Freeness 200 by a number of disintegrator revolutions in the range from about 250,000 to about 350,000, although on occasion a greater number of revolutions may be required. The invention further provides lyocell fibre capable of being beaten to Canadian Standard Freeness 400 in the Disintegration Test by not more than about 150,000 disintegrator revolutions, in particular by a number of disintegrator revolutions within the range from about 30,000 to about 150,000, often within the range from about 50,000 to about 100,000. The invention yet further provides lyocell fibre capable of being beaten to Canadian Standard Freeness 200 in the Disintegration Test by not more than about 200,000 disintegrator revolutions, in particular by a number of disintegrator revolutions within the range from about 50,000 to about 150,000 or 200,000, often within the range from about 75,000 to about 125,000.

Paper made from lyocell fibre according to the invention may be found to have a variety of advantageous properties. It has generally been found that the opacity of paper containing lyocell fibre increases as the degree of beating is increased. This is opposite to the general experience with paper made from woodpulp. The paper may have high air-permeability compared with paper made from 100% woodpulp; this is believed to be a consequence of the generally round cross-section of the lyocell fibres and fibrils. The paper may have good particle-retention when used as a filter. Blends of lyocell fibre of the invention and woodpulp provide papers with increased opacity, tear strength and air permeability compared with 100% woodpulp papers. Relatively long, for example 6 mm long, lyocell fibre may be used in papermaking compared with conventional woodpulp fibres, yielding paper with good tear strength.

Examples of applications for paper containing lyocell fibre provided according to the invention include, but are not limited to, capacitor papers, battery separators, stencil papers, papers for filtration including gas, air and smoke filtration and the filtration of liquids such as milk, coffee and other beverages, fuel, oil and blood plasma, security papers, photographic papers, flushable papers and food casing papers, special printing papers and teabags.

It is an advantage of the invention that hydroentangled fabrics can be made from lyocell fibre provided according to the invention at lower entanglement pressures than are required for untreated lyocell fibre for similar fabric properties, at least for short staple lengths (up to about 5 or 10 mm). This reduces the cost of hydroentanglement. Alternatively, a greater degree of hydroentanglement can be obtained at a given pressure than with prior art lyocell fibres. A hydroentangled fabric made from lyocell fibre provided according to the invention may have better tensile properties than a fabric made from untreated lyocell fibre, although it will be understood that hydroentarnling conditions will need to be optimised by trial and error for the best results in any particular case. A hydroentangled fabric containing lyocell fibre provided according to the invention may exhibit high opacity, high particle retention in filtration applications, increased barrier and wetting properties, high opacity, and good properties as a wipe.

Examples of applications for hydroentangled fabrics containing lyocell fibre provided according to the invention include, but are not limited to, artificial leather and suede, disposible wipes (including wet, lint-free, cleanroom and spectacle wipes) gauzes including medical gauzes, apparel fabrics, filter fabrics, diskette liners, coverstock, fluid distribution layers or absorbent covers in absorbent pads, for example diapers, incontinence pads and dressings, surgical and medical barrier fabrics, battery separators, substrates for coated fabrics and interlinings.

Lyocell fibre provided according to the invention may fibrillate to some extent during dry processes for nonwoven fabric manufacture, for example needlepunching. Such nonwoven fabrics may exhibit improved filtration efficiency in comparison with fabrics containing conventional lyocell fibre.

The fibre provided by the invention is useful in the manufacture of textile articles such as woven or knitted articles, alone or in combination with other types of fibre including prior art lyocell fibre. The presence of the lyocell fibre provided by the invention may be used to provide desirable aesthetic effects such as a peach-skin effect. Fibrillation can be induced in such fabrics by known processes such as brushing and sueding in addition to any fibrillation generated in the wet processing steps normally encountered in fabric manufacture.

Fibre provided according to the invention is useful in the manufacture of teabags, coffee filters and suchlike articles. The fibre may be blended with other fibres in the manufacture of paper and hydroentangled fabrics. The fibre may be blended as a binder with microglass fibre to improve the strength of glass fibre paper made therefrom. The fibre may be felted in blend with wool. The fibre may be used in the manufacture of filter boards for the filtration of liquids such as fruit and vegetable juices, wine and beer. The fibre may be used in the manufacture of filter boards for the filtration of viscous liquids, for example viscose. The fibre may be made into tampons and other absorbent articles with improved absorbency. Lyocell fibre may fibrillate advantageously during dry processing as well as during wet processing, for example during processes such as milling, grinding, sueding, brushing and sanding. Fibrils may be removed from fibrillated lyocell fibre by enzyme finishing techniques, for example treatment with cellulases.

The following procedures identified as Test Methods 1 to 4 were used to assess fibre performance:

Test Method 1—Measurement of Cuprammonium Solution Viscosity and D.P. (the D.P. Test)

This test is based on TAPPI Standard T206 os-63. Cellulose is dissolved in cuprammonium hydroxide solution containing 15±0.1 g/l copper and 200±5 g/l ammonia, with nitrous acid content <0.5 g/l, (Shirley Institute standard) to give a solution of accurately-known cellulose concentration (about 1% by weight). Solution flow time through a Shirley viscometer at 20° C. is measured, from which viscosity may be calculated in standard manner. Viscosity-average D.P. is determined using the empirical equation:

$$D.P.=412.4285 \ln[100(t-k/t)/n.C]-348$$

where t is flow time in seconds, k the gravity constant, C the tube constant, and n the density of water in g/ml at the temperature of the test (0.9982 at 20° C.).

Test Method 2—Measurement of Fibrillation Tendency (Sonication)

Ten lyocell fibres (20±1 mm long) are placed in distilled water (10 ml) contained within a glass phial (50 mm long×25 mm diameter). An ultrasonic probe is inserted into the phial, taking care that the tip of the probe is well-centered and is positioned 5±0.5 mm from the bottom of the phial. This distance is critical for reproducibility. The phial is surrounded with an ice bath, and the ultrasonic probe is switched on. After a set time, the probe is switched off, and the fibres are transferred to two drops of water placed on a microscope slide. A photomicrograph is taken under ×20 magnification of a representative area of the sample. Fibrillation Index ($C_f$) is assessed by comparison with a set of photographic standards graded from 0 (no fibrillation) to 30 (high fibrillation).

Alternatively, $C_f$ may be measured from the photomicrograph using the following formula:

$$C_f=n.x/L$$

where n is the number of fibrils counted, x is the average length of the fibrils in mm, and L is the length in mm of fibre along which fibrils are counted.

The ultrasonic power level and sonication time (5–15 minutes, standard 8 minutes) required may vary. The calibration of the equipment should be checked using a sample of fibre of known fibrillation tendency ($C_f$ 4–5 by Test Method 2) before use and between every group of five samples.

Test Method 3—Measurement of Fibrillation Tendency (The Disintearation Test)

Lyocell fibre (6 g, staple length 5mm) and demineralised water (2 l) are placed in the bowl of the standard disintegrator described in TAPPI Standard T-205 om-88, and disintegrated (simulating valley beating) until the fibre is well-dispersed. Suitable disintegrators are available from Messmer Instruments Limited, Gravesend, Kent, UK and from Buchel van de Korput BV, Veemendaal, Netherlands. The Canadian Standard Freeness (CSF) of the fibre in the resulting slurry or stock is measured according to TAPPI Standard T227 om-94 and recorded in ml. In general, the stock is divided into two 1 l portions for measurement of CSF and the two results are averaged. Curves of CSF against disintegrator revolutions or disintegration time may then be prepared and the relative degree of disintegration required to reach a given CSF assessed by interpolation. The zero point is defined as that recorded after 2500 disintegrator revolutions, which serve to ensure dispersion of the fibre in the stock before CSF measurement.

Test Method 2 is quick to perform, but it may give variable results because of the small fibre sample. Test Method 3 gives very reproducible results. These factors should be taken into account during assessment of fibrillation tendency.

Test Method 4—Measurement of Fibrillation Tendency (Valley Beating)

Lyocell fibre is tested by beating in accordance with TAPPI data sheet T 200 om-85 except that a stock consistency of 0.90% is used. The beater used is preferably one dedicated to the testing of lyocell fibres. Results are best treated as comparative within each series of experiments.

Figure 1:
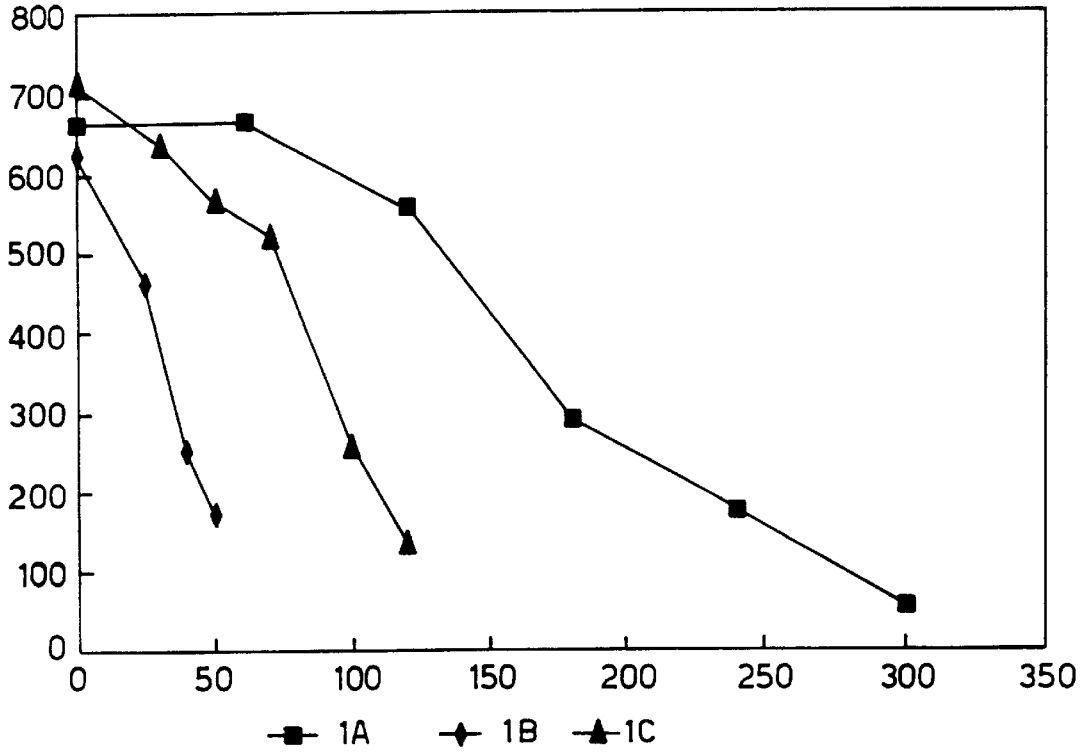
FIGS. 1 and 2 are graphs of the Canadian Standard Freeness, expressed in ml, (y-axis) against the beating time, expressed in min, (x-axis) for the samples in Examples 1 and 2, respectively.

The invention is illustrated by the following Examples, in which lyocell fibre was prepared in known manner by spinning a solution of woodpulp cellulose in aqueous N-methylmorpholine N-oxide:

EXAMPLE 1

Never-dried lyocell fibre tow (1.7 dtex ecru, 300 g samples) was saturated with an aqueous solution containing either hydrogen peroxide (1% by volume) or sodium hypochlorite (1% by weight available chlorine), and in both cases sodium hydroxide (0.5% by weight), and placed in a steamer. The steaming cycle was heating over 7 min., 110° C. for 1 min., and cooling under vacuum over 4 min. The steamed fibre was washed and dried, and exhibited the properties shown in Table 1;

TABLE 1

| Ref. | D.P. | $C_f$ | dtex | ADT cN/tex | ADE % | WT cN/tex | WE % |
|---|---|---|---|---|---|---|---|
| Untreated 1A | 563 | 0–2 | 1.76 | 40.6 | 13.5 | 36.7 | 16.0 |
| Peroxide 1B | 299 | 5–15 | 1.76 | 34.8 | 11.1 | 23.7 | 11.6 |
| Hypo-chlorite 1C | 92 | 20–30 | 1.78 | 23.8 | 6.8 | 18.0 | 8.8 |

(D.P. was measured by Test Method 1. Fibrillation tendency ($C_f$) was measured by Test Method 2. ADT = air-dry tenacity, ADE = air-dry extensibility, WT = wet tenacity, WE = wet extensibility.)

The fibre was hand-cut to 5 mm staple, formed into a web (nominally 60 g/m$^2$), and subjected to hydroentanglement using various jet pressures (measured in bar). The hydroentangled nonwoven lyocell fabric so obtained exhibited the properties shown in Table 2:

TABLE 2

| | | Breaking load (daN) | | | | Overall tenacity (daN/g) | |
|---|---|---|---|---|---|---|---|
| Ref | Jet bar | M.D. dry | M.D. wet | C.D. dry | C.D. wet | dry | wet |
| Untreated 1A | 100 | 3.56 | 2.54 | 4.63 | 2.75 | 4.13 | 2.65 |
| | 160 | 3.84 | 3.25 | 3.74 | 4.01 | 3.79 | 3.65 |
| | 200 | 3.48 | 3.16 | — | — | — | — |
| Peroxide 1B | 75 | 2.77 | 1.07 | 2.63 | 1.51 | 3.60 | 1.75 |
| | 100 | 5.00 | 3.32 | 3.51 | 3.55 | 5.76 | 4.56 |
| Hypochlorite 1C | 75 | 4.77 | 1.12 | 3.34 | — | 5.49 | — |
| | 100 | 5.06 | 1.96 | 4.44 | 1.92 | 4.76 | 1.94 |
| | 160 | 4.24 | 1.46 | 2.40 | 1.08 | 3.45 | 1.28 |

(M.D. = machine direction, C.D. = cross direction)

The treated fibre could be converted into stronger hydroentangled nonwoven fabric than the untreated control under suitable conditions. Notably, several fabrics made from treated fibre exhibited higher overall dry tenacity than any of the controls. This is remarkable in that the treated fibre had inferior tensile properties to the untreated fibre.

The lyocell staple fibre was slurried at stock consistency 0.9% and subjected to valley beating using Test Method 4. The relationship between the CSF of the stock and the beating time is shown in FIG. 1 and Table 3. It can be seen that much shorter beating times were required to reach the same degree of freeness with treated than with untreated

TABLE 3

| | | Beating time min. to reach | |
|---|---|---|---|
| Sample | Ref. | 200 CSF | 400 CSF |
| Untreated | 1A | 226 | 155 |
| Peroxide | 1B | 110 | 65 |
| Hypochlorite | 1C | 46 | 29 |

EXAMPLE 2

Never-dried lyocell tow (1.7 dtex ecru) was treated as follows:

2A. Untreated control.

2B. On-line bleaching, sodium hypochlorite solution (1% by weight available chlorine) at 500° C., bath residence time 4 sec, followed by steaming in a tunnel (100° C. steam) for 25 sec.

2C. As 2B, but bath residence time 7 sec. and steaming time 50 sec.

2D. As 2B, but off-line, bath residence time 60 sec. and steaming as described in Example 1.

2E. As 2D, but 2% by weight available chlorine.

2F. As 2D, but using hydrogen peroxide solution (1% by weight).

The treated fibre was washed and dried and cut into 5 mm staple.

Figure 2:
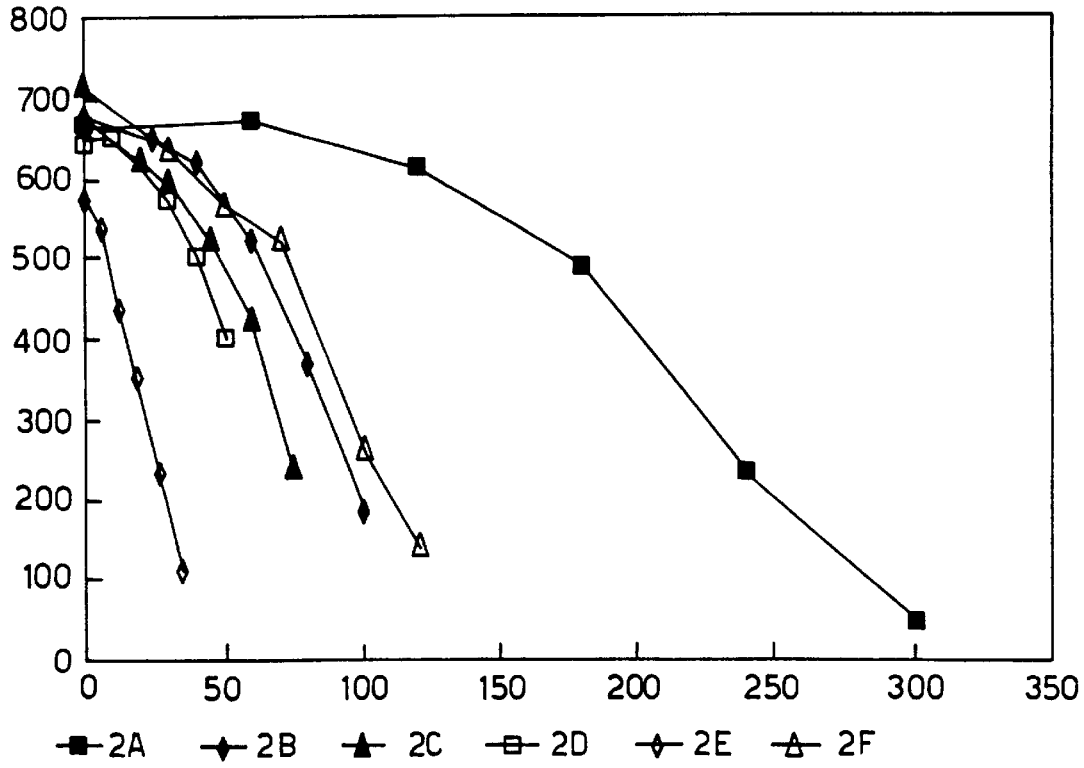

The lyocell staple fibre was slurried at stock consistency 0.9% and subjected to valley beating using Test Method 4. The relationship between the CSF of the stock and the beating time is shown in FIG. 2 and Table 4. It can be seen that much shorter beating times were required to reach the same degree of freeness with treated than with untreated fibre.

TABLE 4

| | Beating time min to reach | |
|---|---|---|
| Sample | 200 CSF | 400 CSF |
| 2A | 248 | 197 |
| 2B | 98 | 75 |
| 2C | — | 61 |
| 2D | — | 50 |
| 2E | 27 | 14 |
| 2F | 109 | 83 |

Beaten slurries of samples 2A–2E were made into paper. The physical properties of all the samples (tear strength, burst index, tensile strength and bulk) were very similar.

The cut staple was formed into webs and hydroentangled as described in Example 1 (jet pressure 100 bar). The samples of fabric so obtained had the properties shown in Table 5:

TABLE 5

| | | | Overall fabric tenacity N/g | |
|---|---|---|---|---|
| | Fibre D.P. | Fibre tenacity CN/tex | Dry | Wet |
| 2A | 524 | 43.2 | 18.6 | 27.9 |
| 2B | 227 | 40.9 | 41.7 | 62.4 |
| 2C | 206 | 36.1 | 35.2 | 69.9 |
| 2D | 159 | 34.7 | 45.5 | 79.6 |
| 2E | 40 | 23.3 | 18.5 | 49.3 |

EXAMPLE 3

Example 2 was repeated, except that the following treatment conditions were used:

3A As 2A.

3B On-line, nitric acid solution (0.72% by weight concentrated nitric acid) at 50° C., bath residence time 4 sec, followed by steaming (25 sec).

3C As 3B, but 2.8% nitric acid.

3D As 3B, but 4.25% nitric acid.

Figure 3:
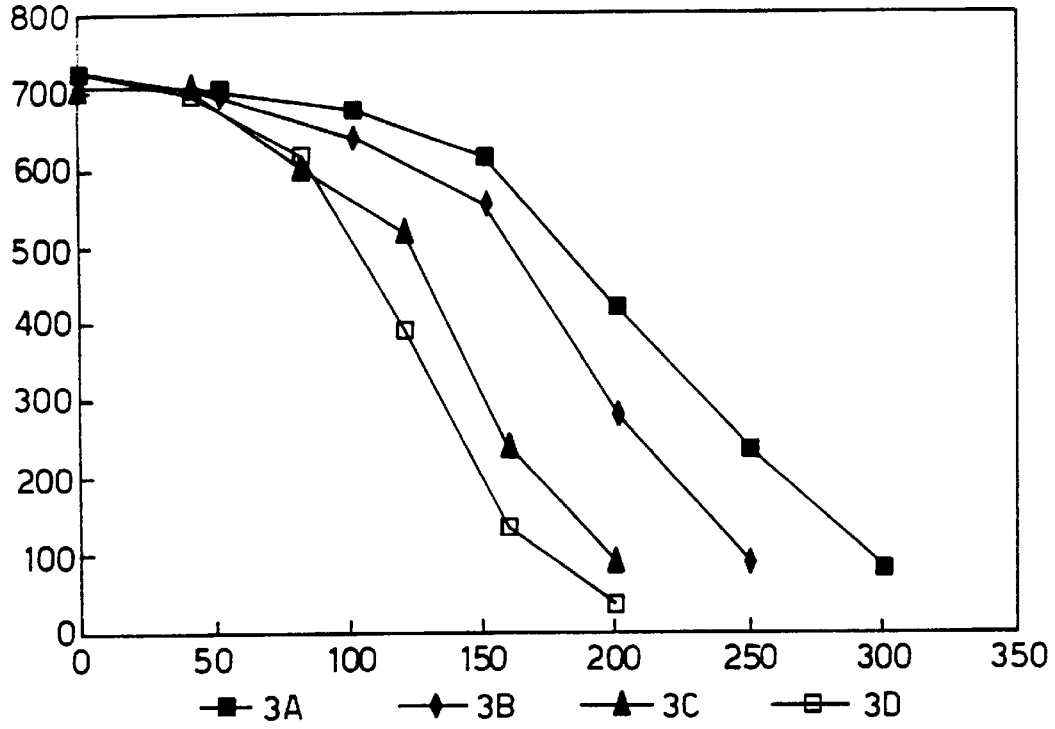
FIGS. 3, 4 and 5 are graphs of the Canadian Standard Freeness, expressed in ml, (y-axis) against the number of disintegrator revolution, expressed in thousands of revolutions, (x-axis) for the samples in Examples 3, 4 and 5, respectively.

The treated fibre was washed and dried and cut into 5 mm staple. The lyocell staple fibre was subjected to disintegration using Test Method 3. The relationship between the CSF of the stock and the beating time is shown in FIG. 3 and Table 6. It can be seen that shorter beating times were required to reach the same degree of freeness with treated than with untreated fibre.

TABLE 6

| Sample | Disintegration rev. ×1000 to reach 200 CSF | 400 CSF |
|---|---|---|
| 3A | 262 | 205 |
| 3B | 221 | 179 |
| 3C | 170 | 138 |
| 3D | 149 | 119 |

EXAMPLE 4

Example 2 was repeated, except that the following treatment conditions were used:

4A Untreated control.

4B Off-line, sodium hypochlorite solution (0.5% by weight available chlorine) at 50° C., bath residence time 60 seconds, no steaming.

4C As 4B, except that the treatment bath additionally contained 15 g/l sodium bicarbonate (pH 8.5). No steaming was used.

4D As 4B, except that the treatment bath additionally contained 15 g/l sodium dihydrogen phosphate (pH 6.8). ^No steaming was used.

4E As 4B, except that the treatment bath additionally contained 7.5 g/l citric acid and 7.5 g/l sodium dihydrogen citrate (pH 5.5). No steaming was used.

4F As 2D.

Figure 4:
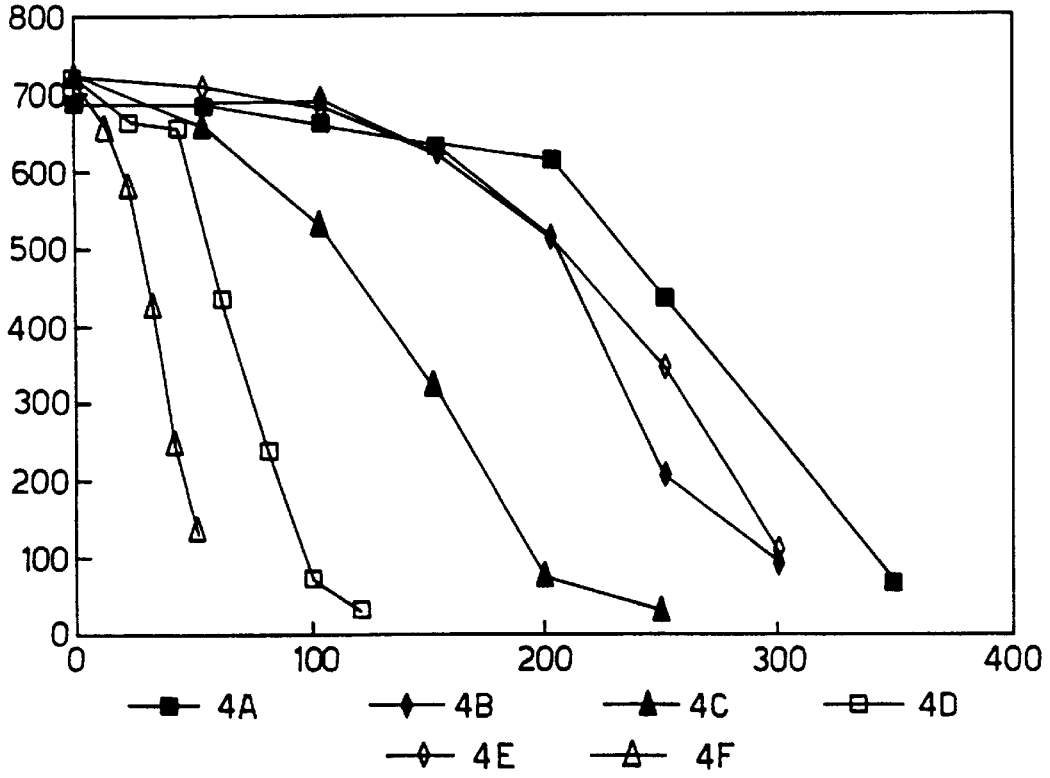

The treated fibre was washed and dried and cut into 5 mm staple. The lyocell staple fibre was assessed using Test Method 3. The relationship between the CSF of the stock and the beating time is shown in FIG. 4 and Table 7. It can be seen that the addition of bicarbonate or phosphate buffer reduced the beating time required to reach any particular degree of freeness.

TABLE 7

| Sample | Disintegration rev. ×1000 to reach 200 CSF | 400 CSF |
|---|---|---|
| 4A | 315 | 261 |
| 4B | 254 | 221 |
| 4C | 176 | 133 |
| 4D | 86 | 65 |
| 4E | 280 | 230 |
| 4F | 43 | 32 |

EXAMPLE 5

Example 2 was repeated, except that the following treatment conditions were used:

5A Untreated control.

5B Hydrogen peroxide solution (1.0% by weight) at 50° C., on-line at line speed 6 m/min (bath residence 7 sec), followed by steaming for 50 seconds.

5C As 5B, except that the treatment bath additionally contained 0.5% by weight sodium hydroxide.

5D As 5C, except that the treatment bath contained sodium hypochlorite (1% by weight available chlorine) instead of hydrogen peroxide.

Figure 5:
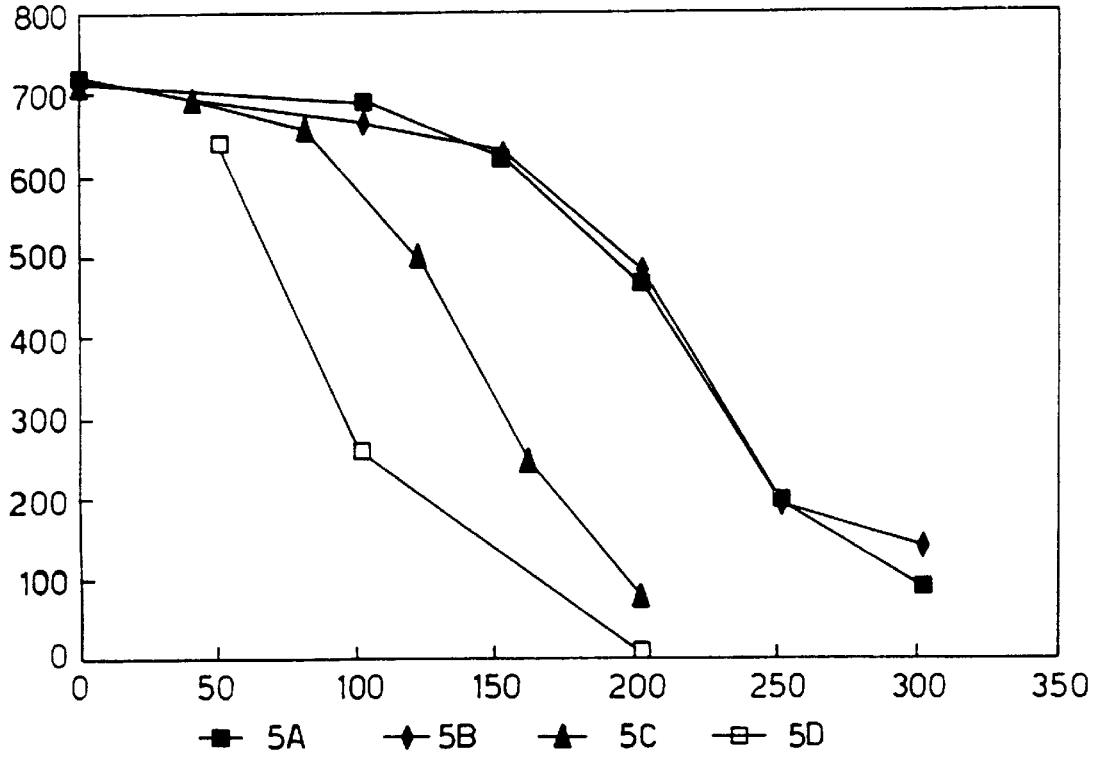

The treated fibre was washed and dried and cut into 5 mm staple. The lyocell staple fibre was assessed using Test Method 3. The relationship between the CSF of the stock and disintegrator revolutions is shown in FIG. 5 and Table 8. It can be seen that addition of sodium hydroxide reduced the beating time required to reach any particular degree of freeness when hydrogen peroxide was employed as bleaching agent.

TABLE 8

| Sample | Disintegration rev. ×1000 to reach 200 CSF | 400 CSF |
|---|---|---|
| 5A | 246 | 211 |
| 5B | 246 | 214 |
| 5C | 189 | 135 |
| 5D | 121 | 80 |

EXAMPLE 6

Lyocell fibre was bleached using the treatment bath liquors described in Example 4 under reference codes 4B, 4C, 4D and 4E at 25 and 50° C. The results shown in Table 9 were obtained:

TABLE 9

| Liquor | Temp ° C. | pH | D.P. | dtex | Tenacity cN/tex | Extension % |
|---|---|---|---|---|---|---|
| None | — | — | 548 | 2.0 | 37.7 | 15 |
| 4B | 25 | 11.46 | 524 | 1.9 | 37.7 | 15 |
| 4B | 50 | 10.71 | 406 | 1.9 | 37.1 | 14 |
| 4C | 25 | 8.65 | 489 | 1.8 | 35.9 | 14 |
| 4C | 50 | 8.64 | 376 | 1.8 | 33.4 | 13 |
| 4D | 25 | 6.73 | 298 | 2.0 | 28.7 | 10 |
| 4D | 50 | 6.69 | 308 | 1.9 | 24.7 | 7 |
| 4E | 25 | 5.67 | 526 | 1.9 | 37.8 | 14 |

The samples treated at 50° C. were those of Example 4.

EXAMPLE 7

Figure 6:
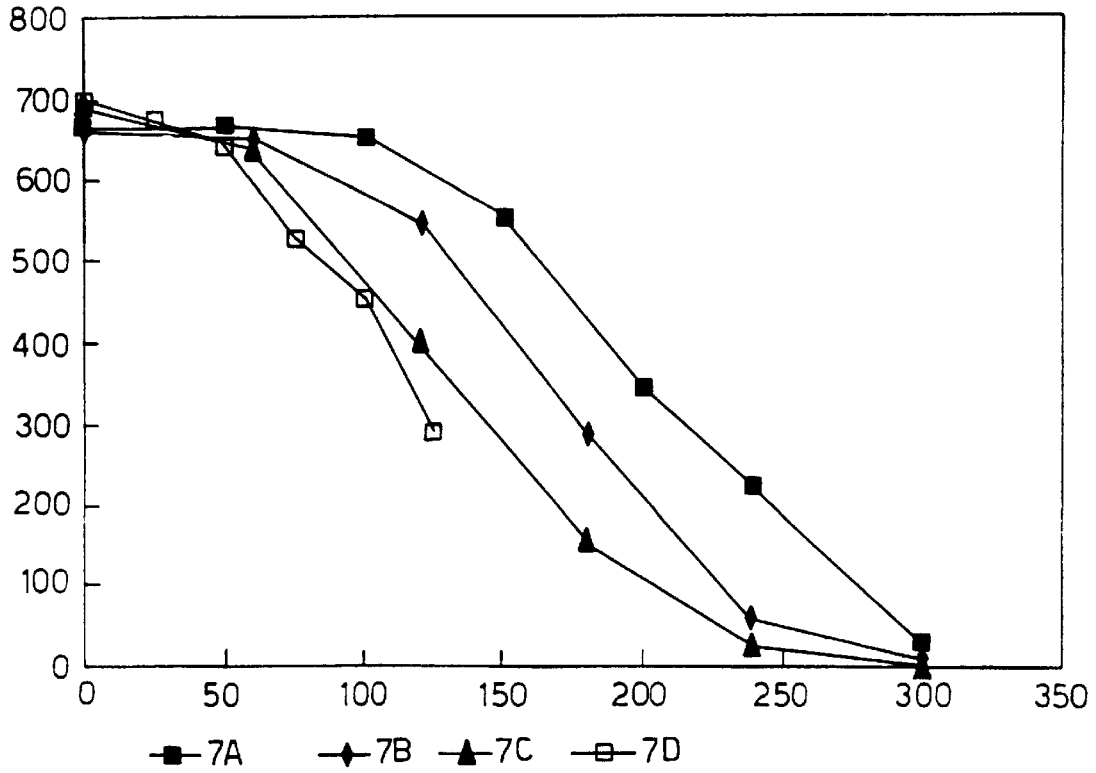
FIGS. 6 and 7 are graphs of the Canadian Standard Freeness, expressed in ml, (y-axis) against the beating time, expressed in min, (x-axis) for the samples in Examples 7 and 8, respectively.

An unpigmented solution of cellulose in aqueous N-methylmorpholine N-oxide was extruded through a plurality of spinnerettes (spinning speed 37 m/min) and washed with water. The titre of the individual filaments was 1.7 dtex and the titre of the combined tow was 64 ktex. The tow was then passed firstly through a bath containing aqueous sodium hypochlorite solution (temperature 76–80° C., steam sparges, residence time 60 sec) and secondly through a circulating bath to which sulphuric acid was continuously added (temperature 67° C., pH 8, residence time approx 5 sec). The tow was then washed with cold water and dried. The fibrillation tendency of the fibre was assessed by Test Method 4. Hypochlorite concentration in the treatment bath and experimental results are shown in FIG. 6 and Table 10.

TABLE 10

| Ref. | Available chlorine % by weight | Beating time min. to reach 400 CSF | 200 CSF |
|---|---|---|---|
| 7A | Control | 187 | 240 |
| 7B | 0.2 | 153 | 204 |
| 7C | 0.3 | 120 | 170 |
| 7D | 0.47 | 109 | — |

EXAMPLE 8

Figure 7:
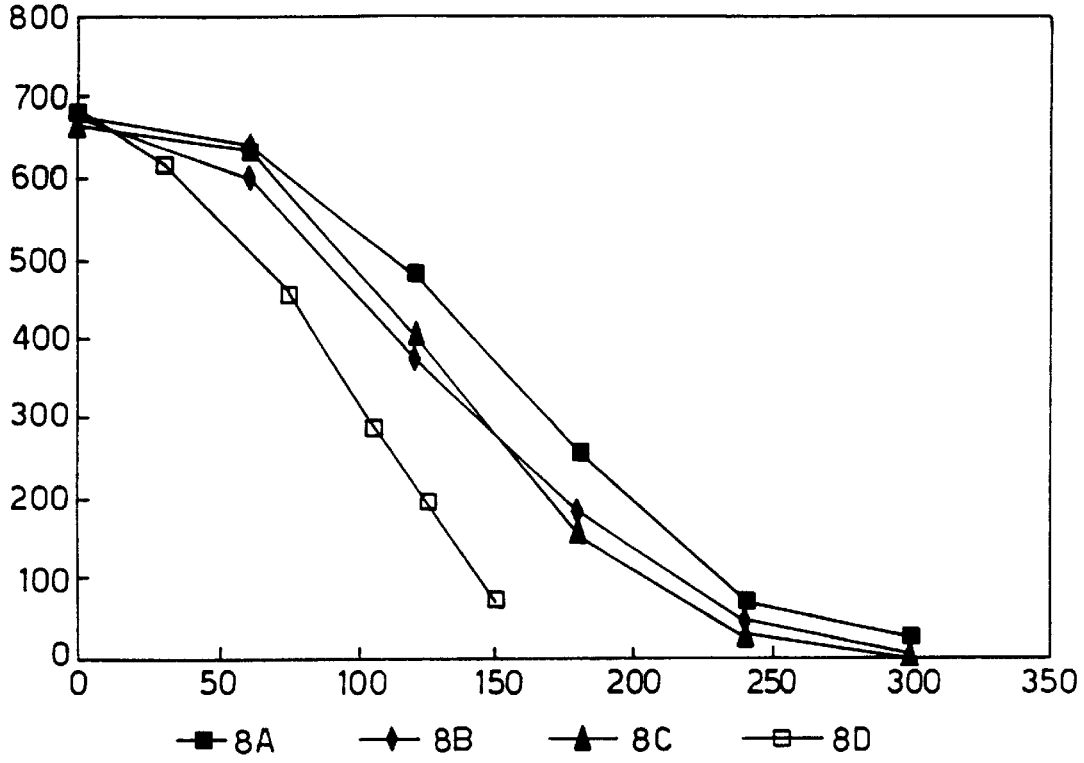

Example 7 was repeated, except that matt fibre (pigmented with titanium dioxide) was used. Hypochlorite concentration in the treatment bath and experimental results are shown in FIG. 7 and Table 11.

TABLE 11

| Ref. | Available chlorine % by weight | Beating time min. to reach 400 CSF | 200 CSF |
|---|---|---|---|
| 8A | Control | 143 | 197 |
| 8B | 0.2 | 122 | 174 |
| 8C | 0.45 | 114 | 167 |
| 8D | 0.65 | 87 | 126 |

EXAMPLE 9

Figure 8:
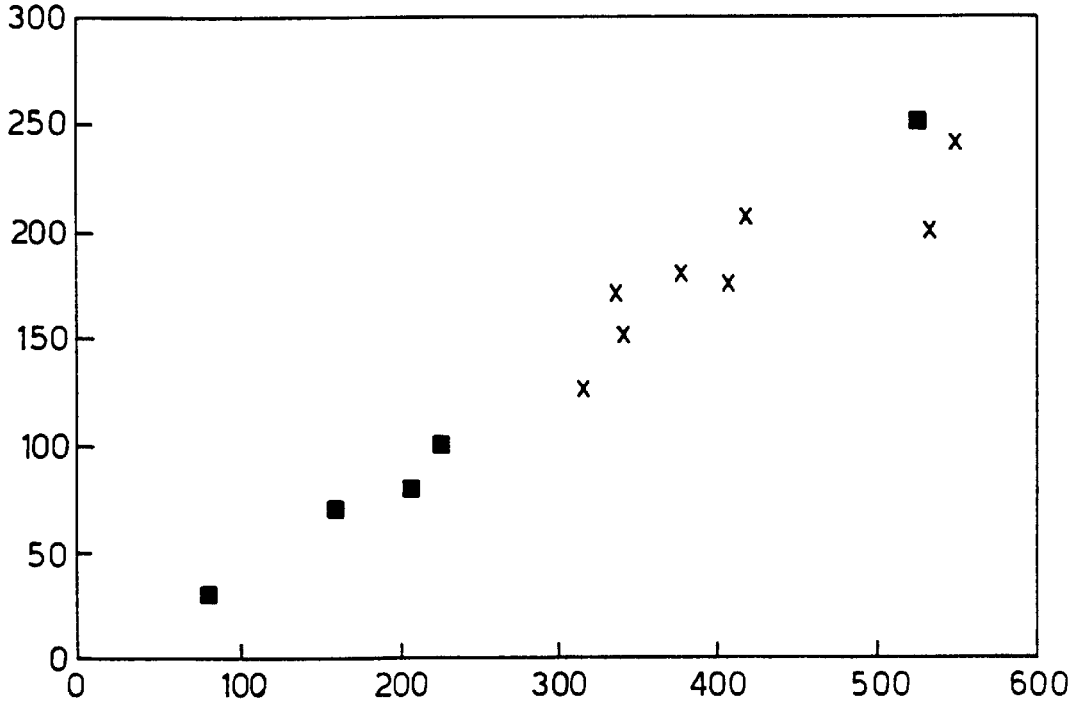
FIG. 8 is a graph of beating time required to achieve Canadian Standard Freeness 200, expressed in min, (y-axis) against Fibre D.P. (x-axis) for the samples in Example 9.

Lyocell fibre was degraded according to the invention under various conditions, and its D.P. and beating performance assessed using Test Methods 1 and 4 respectively. The relationship between the beating time to 200 CSF and the fibre D.P. is shown in FIG. 8. (The data plotted with a cross are factory trials and the data plotted with a filled square are laboratory trials.) The three samples with D.P. above 500 are untreated controls.

EXAMPLE 10

Lyocell fibre was spun from a solution in aqueous N-methylmorpholine N-oxide of "Viscokraft" (Trade Mark of International Paper Co., USA) pulp of nominal D.P. 600 with nominal cellulose concentration 15%, washed, saturated with solutions of various reagents (bath temperature 50° C., residence time 60 seconds), steamed in the manner of Example 1 for 60 seconds, and dried. The D.P. and Fibrillation Index $C_f$ of the fibre were assessed by Test Methods 1 and 2. The results shown in Table 12 were obtained:

TABLE 12

| Reagents | Steam temp ° C. | D.P. | $C_f$ |
|---|---|---|---|
| Untreated control | — | 565 | 1.3 |
| Series 1 | | | |
| 0.5% NaOH | 110 | 567 | 0.7 |
| 0.05% NaOCl | 110 | 548 | 2.1 |
| 0.25% NaOCl | 110 | 427 | 1.8 |
| 0.5% NaOCl | 110 | 306 | 3.7 |
| 1.0% NaOCl | 110 | 178 | 11.0 |
| 2.0% NaOCl | 110 | 44 | 30.0 |
| Series 2 | | | |
| 1.0% NaOCl + 0.5% NaOH | — | 508 | 1.1 |
| Series 3 | | | |
| 1.0% NaOCl + 0.5% NaOH | 100–120 | 169–176 | 8.7–11.0 |
| 1.0% NaOCl + 0.05% NaOH | 110 | 109 | 20.3 |
| 1.0% NaOCl + 0.25% NaOH | 110 | 139 | 18.4 |
| 1.0% NaOCl + 0.5% NaOH | 110 | 155 | 20.0 |
| 1.0% NaOCl + 1.0% NaOH | 110 | 168 | 15.1 |
| 1.0% NaOCl + 2.0% NaOH | 110 | 194 | 7.3 |

NaOCl concentration is expressed in terms of percent by weight of available chlorine. NaOH concentration is expressed in terms of percent by weight. It will be observed that the bleached samples of low D.P. had markedly higher fibrillation indices than any of the unbleached samples. It will also be recognised that solutions of cellulose whose D.P. is below about 200 cannot readily be spun into fibre by solvent-spinning processes.

EXAMPLE 11

Never-dried lyocell tow was passed through a bleach bath containing 0.5% by weight NaOH and a bleaching agent, steamed (steam temperature 100° C.), washed and dried. The D.P. and Fibrillation Index $C_f$ of the dried fibre were assessed. Experimental conditions and results are shown in Table 13, $C_f$ being quoted as the observed range between different photographs.

Table 13

TABLE 13

| Agent | Bleach Bath Temp ° C. | Time sec | Steaming Time sec | D.P. | $C_f$ |
|---|---|---|---|---|---|
| Control | — | — | — | 532 | 1–2 |
| 1.0% $H_2O_2$ | 60 | 50 | 25 | 426 | 3–5 |
| 1.11% NaOCl | 40 | 50 | 50 | 205 | 4–12 |
| 1.11% NaCCl | 40 | 25 | 25 | 249 | 2–8 |
| 1.10% NaOCl | 60 | 50 | 5o | 203 | 4–16 |
| 1.10% NaOCl | 60 | 25 | 25 | 227 | 7–14 |
| 0.98% NaOCl | 70 | 50 | 50 | 221 | 4–10 |
| 0.98% NaOCl | 70 | 25 | 25 | 251 | 2–10 |
| 1.00% NaOCl | 60 | 50 | 25 | 235 | 6–8 |

(% NaOCl is % by weight available chlorine, % $H_2O_2$ is % by weight)

An appreciable increase in fibrillation tendency was observed in all cases.

EXAMPLE 12

Previously-dried 1.7 dtex 5 mm bright lyocell fibre (200 kg) was bleached in aqueous sodium hypochlorite (3 g/l available chlorine) at 40° C. for 75 minutes, soaked in aqueous sodium metabisulphite (1 g/l) as antichlor for 30 minutes, washed with dilute acetic acid to return fibre pH to neutral, and dried. The nominal D.P. of the cellulose from which the fibre was made was 600 and the average D.P. of the treated fibre was 217 (range 177–230, six samples). Disintegration Test results for the treated sample and for an untreated control sample are shown in Table 14.

TABLE 14

| Disintegrator revolutions | 0 | 100,000 | 150,000 |
|---|---|---|---|
| Control sample CSF | 650 | 620 | 510 |
| Treated sample CSF | 656 | 400 | 80 |

EXAMPLE 13

A 8 ktex tow of never-dried 1.7 dtex bright lyocell fibre was passed through a first aqueous bath containing copper (II) sulphate (0.1% w/w) and a second aqueous bath containing hydrogen peroxide (4% w/w) and sodium hydroxide (0.5% w/w). The temperature of each bath was 20–25° C., and the residence times in the baths were 10 and 131 seconds respectively. The tow was then passed through a steam tunnel at 100° C. with residence time 120 seconds, rinsed and dried. A sample treated as above, but with the omission of the copper sulphate bath, and an untreated control sample were also prepared. Disintegration Test results are given in Table 15.

TABLE 15

| Disintegrator revolutions × 1000 | 0 | 50 | 75 | 100 | 175 | 200 |
|---|---|---|---|---|---|---|
| Untreated control sample CSF | 697 | — | — | 672 | — | 611 |
| Treated sample (no CuSO4) | 715 | — | — | 491 | 66 | — |
| Treated sample (with CuSO4) | 702 | 335 | 124 | — | — | — |

A dash indicates that no measurement was made.

EXAMPLE 14

A 5.3 ktex tow of 1.7 dtex bright lyocell fibre was passed through an aqueous bath containing sodium hypochlorite (17–20° C., residence time 42 sec.), next through a steam tunnel (100° C., residence time 120 sec.), rinsed and dried. Fibrillation tendency was measured by Test Method 3 on fibre cut to 5 mm staple, and the number of disintegrator revolutions (in thousands, krev) required to reach 200 CSF estimated by graphical interpolation. Other experimental details and results are shown in Table 16.

TABLE 16

| Bath | D.P. | dtex | Tenacity cN/tex | Extension % | krev to 200 CSF |
|---|---|---|---|---|---|
| None (control) | 533 | 1.88 | 36.2 | 11 | 307 |
| 0.1% A.Cl | 429 | 1.85 | 36.7 | 11 | 228 |
| 0.3% A.Cl | 341 | 1.69 | 37.3 | 11 | 190 |
| 1.0% A.Cl | 154 | 1.68 | 34.1 | 1 | 100 |
| 2.0% A.Cl | 49 | 1.91 | 22.0 | 6 | 61 |
| 1.0% A.Cl + 0.5% NaOH | 242 | 1.80 | 37.0 | 12 | 140 |

(A.Cl = available chlorine, % = per cent by weight)

EXAMPLE 15

A 10.6 ktex tow of 1.7 dtex bright lyocell fibre was passed through an aqueous bath containing sodium hypochlorite (16–18° C., residence time 132 sec.), next through a steam tunnel (100° C., residence time 120 sec.), rinsed and dried. Fibrillation tendency was measured as described in Example 14. Other experimental details and results are shown in Table 17.

TABLE 17

| Bath | D.P. | krev to 200 CSF |
|---|---|---|
| None (control) | 501 | 341 |
| 0.5% $H_2O_2$ + 0.5% NaOH | 180 | 123 |
| 1.0% $H_2O_2$ + 0.5% NaOH | 158 | 113 |
| 2.0% $H_2O_2$ + 0.5% NaOH | 156 | 117 |
| 3.0% $H_2O_2$ + 0.5% NaOH | 147 | 113 |
| 4.0% $H_2O_2$ + 0.5% NaOH | 120 | 87 |

(% = per cent by weight)

EXAMPLE 16

Never-dried bright lyocell tow (various fibre titres, i.e. dtex) was soaked in an aqueous solution containing sodium hypochlorite (1% by weight available chlorine) and sodium hydroxide (0.5% by weight), steamed for 1 minute as described in Example 1, washed, dried and cut to 5 mm staple length. The D.P. and fibrillation tendency (Test Method 3) of the treated fibre and of untreated control samples are reported in Table 18.

TABLE 18

| | Control | | | Treated | | |
|---|---|---|---|---|---|---|
| | | CSF | | | CSF | |
| Fibre dtex | D.P. | 0 rev | 100 krev | D.P. | 0 rev | 100 krev |
| 1.7 | 530 | 685 | 656 | 136 | 658 | 179 |
| 2.4 | 540 | 698 | 673 | 140 | 695 | 413 |
| 3.4 | 557 | 705 | 696 | 136 | 705 | 560 |

EXAMPLE 17

Never-dried bright lyocell tow (1.7 dtex/filament, 15.4 ktex total) was passed at 6.4 m/min through an application bath containing 4% by weight hydrogen peroxide and 0.5% by weight sodium hydroxide (temperature 17–19° C., residence time 125–130 sec.), then through a steam tunnel (100° C., residence time 120 sec.), washed and dried. The washing step optionally included a wash with 2% by weight hydrochloric acid. The fibrillation properties of the fibre and of an untreated control (measured by the Disintegration Test) are reported in Table 19.

TABLE 19

| | krev to 400 CSF | krev to 200 CSF |
|---|---|---|
| Control | 185 | 235 |
| Treated (12 samples) | 75–100 | 95–120 |

We claim:

1. A process for the manufacture of lyocell fibre comprising the steps of:

(1) dissolving cellulose in a solvent to form a solution, (2) extruding the solution through a die to form a plurality of filaments, (3) washing the filaments to remove the solvent, thereby forming lyocell fibre, the cellulose in the lyocell fibre having a first Degree of Polymerisation, and (4) reducing the Degree of Polymerisation of the cellulose in the lyocell fibre to a second Degree of Polymerisation, said second Degree of Polymerisation being at least 200 units less than said first Degree of Polymerisation, whereby the resulting fibre displays an increased tendency to fibrillation as compared to the lyocell fibre of step (3).

2. A process according to claim 1, wherein the solvent comprises a tertiary amine N-oxide.

3. A process according to claim 2, wherein the tertiary amine N-oxide is N-methlymorpholine N-oxide.

4. A process according to claim 1, wherein the Degree of Polymerisation of the cellulose is reduced in step (4) by at least 300 units.

5. A process according to claim 1, wherein the Degree of Polymerisation of the cellulose after step (4) is below 250 units.

6. A process according to claim 1, wherein the Degree of Polymerisation is reduced in step (4) by a bleaching treatment.

7. A process according to claim 6, wherein the bleaching treatment comprises applying to the fibre a bleaching liquor which is an aqueous solution comprising sodium hypochlorite.

8. A process according to claim 7, wherein the concentration of sodium hypochlorite in the bleaching liquor expressed as available chlorine is in the range 0.5 to 2.0 percent by weight.

9. A process according to claim 6, wherein the bleaching treatment comprises applying to the fibre a bleaching liquor which is an aqueous solution comprising hydrogen peroxide.

10. A process according to claim 1, wherein step (4) is performed on never-dried lyocell fibre.

11. A process according to claim 1, wherein step (4) is performed on previously-dried lyocell fibre.

* * * * *

UNITED STATES PATENT AND TRADEMARK OFFICE

CERTIFICATE OF CORRECTION

PATENT NO. : 6,042,769

DATED : 3/28/2000

INVENTOR(S) : Gannon et al.

It is certified that error appears in the above-identified patent and that said Letters Patent is hereby corrected as shown below:

Column 2, line 33, delete "viscosimetry" and insert --viscometry--.

Column 2, line 60-61, delete "may if desired be applied" and insert --may, if desired, be applied--

Column 3, line 46, insert "to" after --step (4) according--

Column 4, line 43-44, delete "degredation" and insert --degradation--

Column 7, line 7, delete "cellulases" and insert --celluloses--

Column 11, line 26, delete "^No" and insert --No--

Column 16, line 54, insert --of-- after "range"

Signed and Sealed this

Eleventh Day of July, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 6,042,769

DATED : March 28, 2000

INVENTOR(S) : J. Gannon et al.

It is certified that error appears in the above-identified patent and that said Letters Patent is hereby corrected as shown below:

Col. 1, line 14, replace "Lyccell" with --Lyocell__

Col. 2, line 29, replace "unzigmented" with --unpigmented--

Col. 3, line 51, replace "equipment6" with --equipment--

Col. 7, line 61, in the title "Test Method 3", replace "Disintearation" with --Disintegration--

Col. 8, line 26, replace "0.90%" with --0.9%--

Col. 9, line 48, after "untreated", insert --fibre.--

Col. 9, line 56, in Table 3, Fourth column, replace "65" with --85--

Col. 9, line 65, replace "500°C" with --50°C--

Col. 14, line 15, in Table 13, fourth column, replace "5o" with --50--

Signed and Sealed this

Twenty-fourth Day of October, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 6,042,769
DATED : March 28, 2000
INVENTOR(S) : James Martin Gannon et al.

It is certified that error appears in the above-identified patent and that said Letters Patent is hereby corrected as shown below:

Column 7,
Line 7, the last word should read -- celluloses --.

Signed and Sealed this

Twenty-seventh Day of May, 2003

JAMES E. ROGAN
*Director of the United States Patent and Trademark Office*